United States Patent [19]

Riegler et al.

[11] 4,423,515

[45] Dec. 27, 1983

[54] ELECTRIC FURNACE

[75] Inventors: Ernst Riegler, Enns; Ernst Zajicek, Ottensheim, both of Austria

[73] Assignee: Voest-Alpine Aktiengesellschaft, Linz, Austria

[21] Appl. No.: 336,896

[22] Filed: Jan. 4, 1982

[30] Foreign Application Priority Data

Jan. 8, 1981 [AT] Austria ..... 30/81

[51] Int. Cl.[3] ..... F27D 1/18

[52] U.S. Cl. ..... 373/81; 91/216 A; 92/117 R

[58] Field of Search ..... 373/81, 73, 98; 91/216 R; 92/117 A, 117 R

[56] References Cited

U.S. PATENT DOCUMENTS 1,818,239 8/1931 Moore ..... 373/81 X 3,181,436 5/1965 McCreery ..... 92/117 R

*Primary Examiner*—Roy N. Envall, Jr.

*Attorney, Agent, or Firm*—Brumbaugh, Graves, Donohue & Raymond

[57] ABSTRACT

In an electric furnace a lifting means actuating the furnace cover includes a king post supported on the base. The king post is surrounded by a sleeve, which is liftable and lowerable relative to the same and has a cap on its upper end. The sleeve is hydraulically liftable and engageable with a cover carrying framework carrying the furnace cover. In order to provide for a lifting means with a low weight without constraining forces and with a structurally simple lubrication, a cylinder space to which a hydraulic medium is admitted is provided between a front face of the king post and the cap of the sleeve acting in the lifting direction. If desired, an annular space is provided between a collar of the king post and the inner wall of the sleeve, to which a hydraulic medium is provided, acting in the lowering direction.

8 Claims, 6 Drawing Figures

ELECTRIC FURNACE

BACKGROUND OF THE INVENTION

The invention relates to an electric furnace, such as an electric arc furnace or a plasma melting furnace, with a lifting means actuating the furnace cover and comprising a king post supported on a base and a sleeve surrounding the king post and being liftable and lowerable relative to the same and provided with a cap on its upper end, which sleeve is hydraulically liftable and engageable with a cover carrying structure carrying the furnace cover.

With known furnaces of this kind a hydraulic cylinder piston unit acting only in the lifting direction is installed between a front-side recess of the king post and the bottom of the sleeve.

Articulation bearings are installed between the king post and the sleeve, which are fastened to the sleeve and are moved with the same.

The recess provided in the king post for the cylinder piston unit necessitates a larger diameter of the king post and thus of the sleeve, the known structure thus having a considerable weight.

Due to the double guidance of the sleeve at the king post, i.e., by means of the articulation bearings on the one hand and by means of the hydraulic cylinder-piston unit on the other hand, constraining forces occur, which delimit the functionability of the structure and also cause an increased wear. Jamming of the sleeve on the king post might occur, possibly causing difficulties to arise during lowering, namely when the load support provided on the sleeve for the cover supporting structure gets jammed on the same and the weight of the sleeve does not suffice for counteracting these jamming forces and the constraining forces resulting from the double guidance thus impeding the lowering movement. In this case the furnace has to be set out of operation.

SUMMARY OF THE INVENTION

The invention aims at avoiding these disadvantages and difficulties and has as its object to provide an electric furnace of the initially defined kind whose lifting means has a lower weight as compared to the known structures and in which no constraining forces which restrict occur the functionability of the structure. Furthermore, it should be possible to provide an effective and structurally simply lubrication for the bearings and guides arranged between the king post and the sleeve. In order to achieve a safe detachment of the sleeve from the cover carrying structure, the lifting means of the electric furnace is to be actuatable also in the lowering direction, if necessary.

This object is achieved according to the invention in that, between a front face of the king post and the bottom of the sleeve, a cylindrical space is provided, to which an hydraulic medium is admitted, acting in the lifting direction. If necessary, between a collar of the king post and inner wall of the sleeve, an annular space is provided, to which an hydraulic medium is admitted, acting in the lowering direction.

According to a first embodiment, bearing bushes, preferably of bronze, are arranged between the king post and the sleeve, which are fastened to the king post in a spaced-apart manner.

In order to realize a structurally simple lubrication of the bearing bushes by the hydraulic medium used for the lifting procedure, a further annular space is provided between an upper and a lower bearing bush, which is connected with the cylindrical space by a bore in the king post.

Advantageously, the annular space acting in the lowering direction is formed below the lower bearing bush.

According to a further embodiment, the bearing bushes are fastened to the inner wall of the sleeve in a spaced-apart manner and are movable with the same, the annular space acting in the lowering direction suitably being formed between an upper bearing bush and a collar of the king post arranged above this bearing bush.

In order to ensure a structurally simple lubrication of the bearing bushes arranged between the sleeve and the king post also in this embodiment, a further annular space is advantageously provided between the upper and lower bearing bushes, which is connected with the annular space acting in the lowering direction by one or more channels running through the upper bearing bush. Suitably, a control value is provided for hydraulically connecting, or separating, the cylindrical space with the annular space acting in the lowering direction.

BRIEF DESCRIPTION OF THE DRAWINGS

The invention will now be explained in more detail with reference to the accompanying drawings, wherein.

DESCRIPTION OF EXEMPLARY EMBODIMENTS

Figure 1:
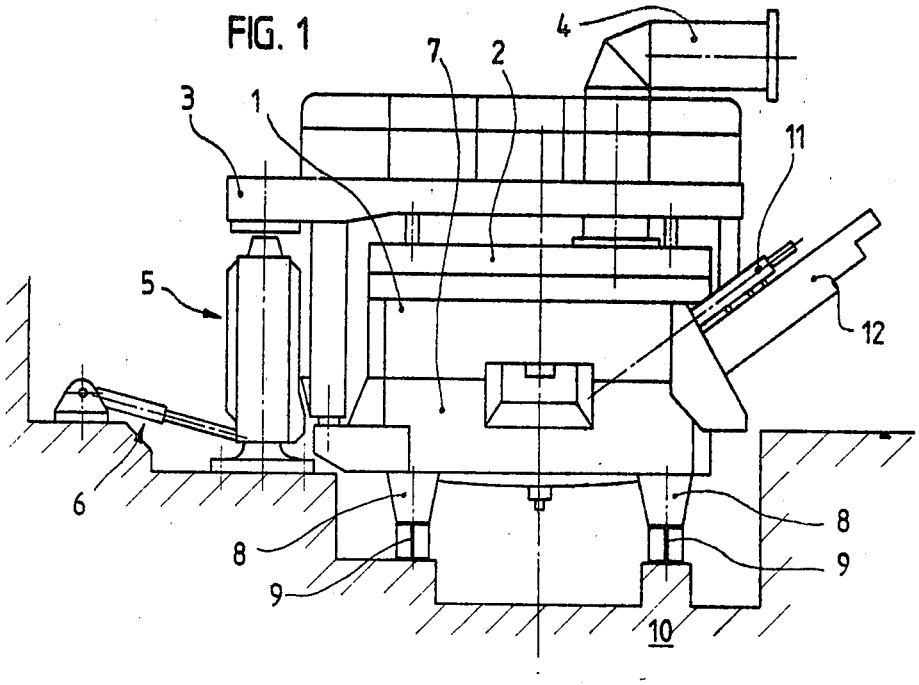
FIG. 1 is a side view of a plasma melting plant.
Figure 2:
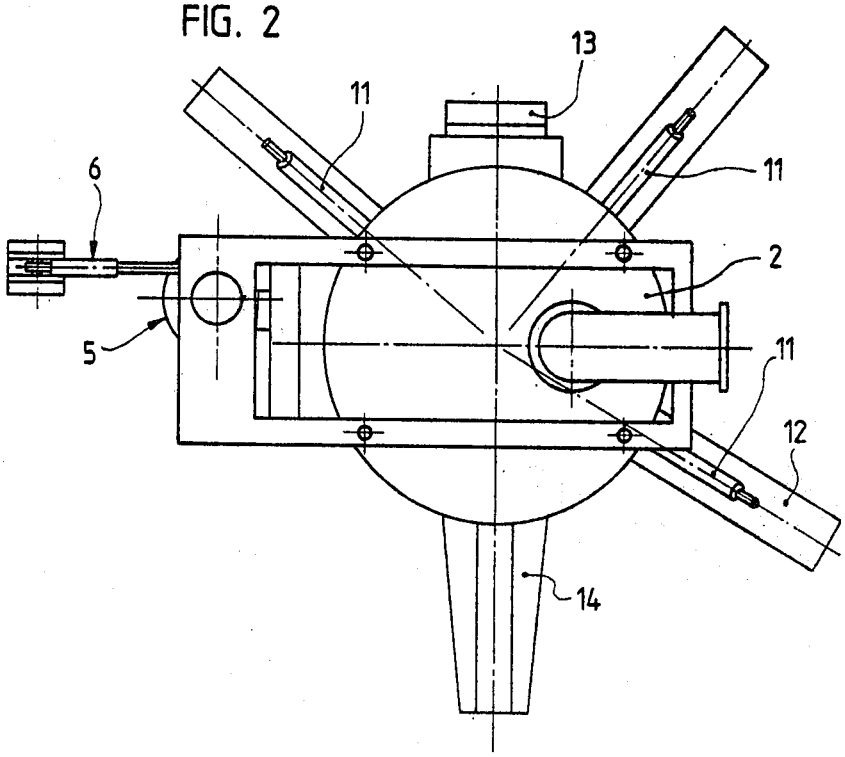
FIG. 2 is a ground section thereof.

A furnace upper section 1 of a plasma melting furnace, in particular a plasma primary melting furnace, is provided with a cover 2, carried by a cover carrying structure 3. A flue gas bend 4 projects out of the cover towards an exhaust (not illustrated). Laterally beside the furnace upper section 1, the cover lifting means 5 and the cover pivoting means 6 are provided. The furnace lower section 7, via movable beams 8, rests on running paths 9 that are supported on the base 10. Each of the three plasma burners 11 is displaceably mounted on an oblique burner mechanism 12. The slag door is denoted by 13, the pouring spout is denoted by 14.

The cover lifting means 5 comprises a king post 15, which is rigidly connected, e.g., screwed, to the base 10, and a sleeve 16 surrounding the king post, which is liftable and lowerable relative to the king post. The sleeve 16 on its upper end is closed by a cap 17. This bottom on its outer side comprises a cone-shaped load support 18, which, with the cover carrying structure 3 and the sleeve 16 in the lower position, is at a distance 19 below the cover carrying structure 3, so that, on the one hand, no oscillations of the cover carrying structure 3 can be transmitted to the cover lifting means during the melting procedure and, on the other hand, the furnace vessel 1, 7 can be tilted into the pouring or slagging position without impediment. In the lifted position of the sleeve 16 and thus of the cover carrying structure 3, the load support 18 projects into a corresponding recess 20 provided in the cover carrying structure.

An oblique surface 21 provided near the lower end of the sleeve 16 engages during lifting with a correspondingly oblique counter surface 22 arranged on a vertical standard 23 of the cover carrying structure 3. The oblique surface 21 has a projection 24, which, with the sleeve 16 lifted, snaps in a corresponding groove of the oblique counter surface 22 for securing its position.

The vertical standard 23, which rests on the furnace lower part 7 with the cover carrying structure being in the lowered position, with a pin 25 arranged on its lower end, projects into a corresponding recess of the furnace lower part 7 with the cover carrying structure being in the lowered position.

Between the sleeve 16 and the king post 15, two bearing bushes 27, 28, preferably antifriction bearing bushes of bronze, are provided, which are fastened to the king post 15 at a distance 26 from each other. The lower one (27) of the two bearing bushes is supported on a collar 30 of the king post via a seal 29 inserted in a casing. The upper one (28) of the two bearing bushes is arranged on the upper end of the king post and is fastened to the same by means of a cover plate 32 constituting a front face 31 of the king post 15. Between the two bearing bushes 27, 28, a distance sleeve 33 is provided, which, however, does not completely fill up the space between the bearing bushes 27, 28 present between the king post 15 and the sleeve 16, but leaves free a narrow annular space 34.

The sleeve 16, with its lower end, reaches beyond the collar 30 of the king post 15 with an inwardly projecting flange 35, which is sealed off relative to that portion of the post which is below the collar of the king post, by means of an annular seal 36. The annular space 37 thus formed by the collar 30, the inner wall of the sleeve 16, the flange 35 and the outer surface of the king post 15 acts in the lowering direction when an hydraulic medium is admitted. The maximum height 38 of the lower annular space (it is reached with the sleeve 16 lowered) corresponds to the required stroke of the cover.

Figure 4:
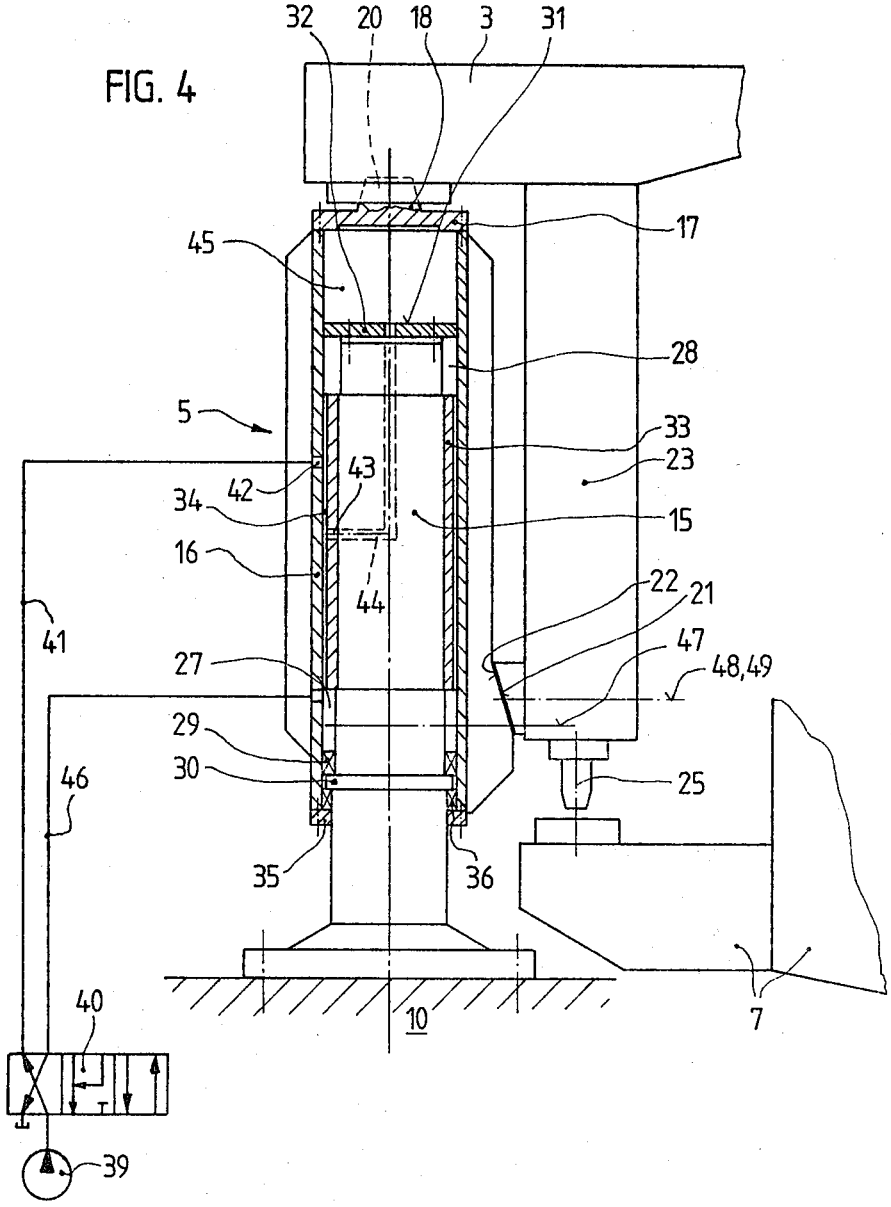

The hydraulic medium, from a pump 39, reaches a bore 42 of the sleeve 16 via a four-way valve 40 by an hydraulic conduit 41, and from there gets into the annular space 34 provided between the sleeve and the king post. From there, the medium flows through a bore 43 provided in the distance sleeve 33 to a further bore 44 reaching through the king post 15 as far as to its front face 31, into the cylindrical space 45 between the front face 31 and the cap 17 of the sleeve. By lifting the sleeve 16 and after the load support 18 and the oblique surface 21 have come into engagement with the cover carrying structure 3, the hydraulic medium raises the cover carrying structure 3. The position of the four-way valve 40 that is required for the lifting procedure is illustrated in FIG. 4.

Figure 3:
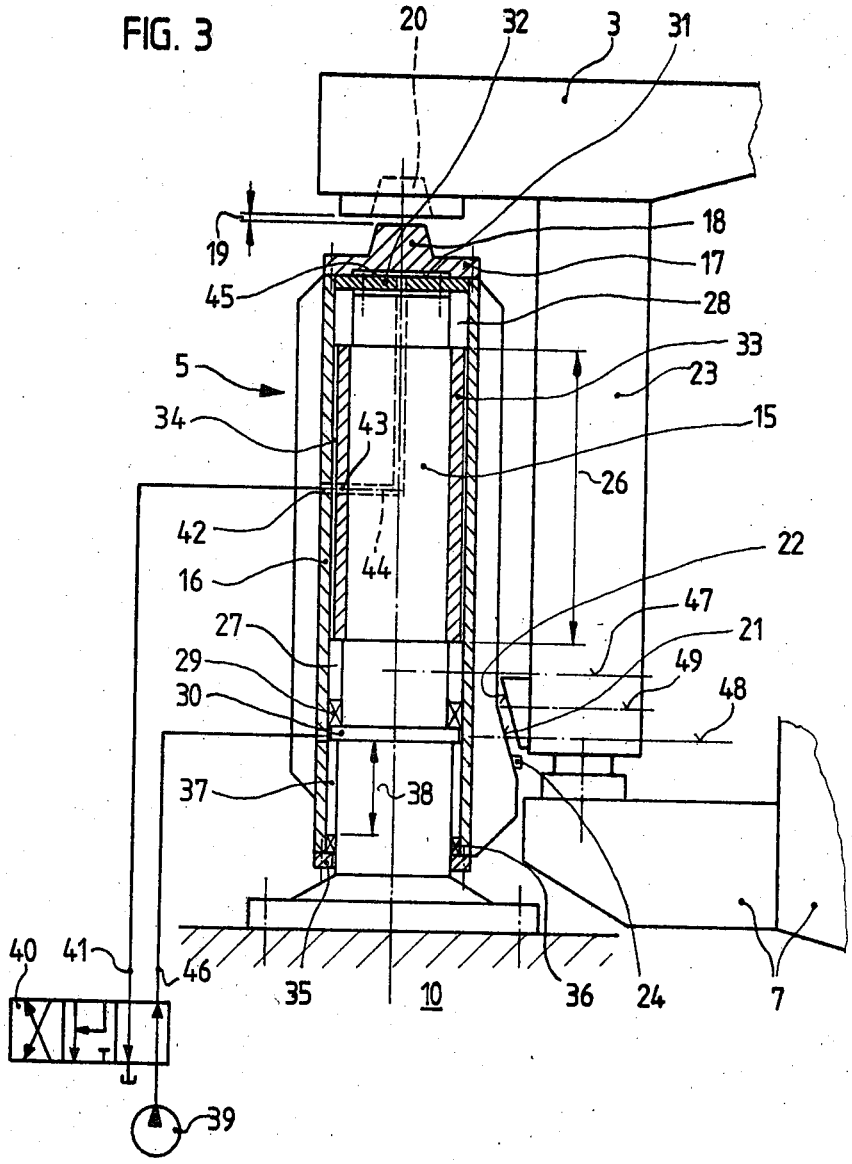
FIGS. 3 and 4 are sections through the cover lifting means, in the lowered position (FIG. 3) and in a raised position (FIG. 4) of the cover carrying structure.

In FIG. 3 the position of the four-way valve 40 during lowering is illustrated. The hydraulic medium, via an hydraulic conduit 46, reaches the lower annular space 37 provided between the collar 30 of the king post 15 and the flange 35 of the sleeve 16, where it acts in the lowering direction of the sleeve 16.

The lowering procedure may be effected without admitting the hydraulic medium of this lower annular space 37 at least until the cover carrying structure 3 has come to rest on the furnace lower part 7 with its vertical standard. If the conical load support 18 gets jammed in the corresponding recess 20 of the cover carrying structure 3 and if the sleeve's own weight does not suffice to undo this jamming, the hydraulic medium is admitted to the lower annular space 37 and the sleeve 16 is lowered further.

The supply of the hydraulic medium into the annular space 34 provided between the antifriction bearing bushes 27, 28 during the lifting and pivoting procedure has the advantage that the antifriction bearing bushes get lubricated well by the hydraulic medium during the lifting and pivoting procedure.

The central line 48 of the oblique surface 21, in the lowered position of the sleeve 16, is at half the lifting height 38 below the central line 47 of the lower antifriction bearing bush 27, so that the oblique counter surface 22 is supported on the oblique surface 21 above the lower antifriction bearing bush 27 at a height that corresponds to half the lifting height 38 (measured on the central lines 47, 48, 49 of the oblique surface 21 and the oblique counter surface 22 and the articulation bearing bush 27) with the cover carrying structure being lifted. Thereby, a favorable force introduction into the king post is attained in a manner that the sleeve 16 is subjected to a minimum of bending moments.

Figure 5:
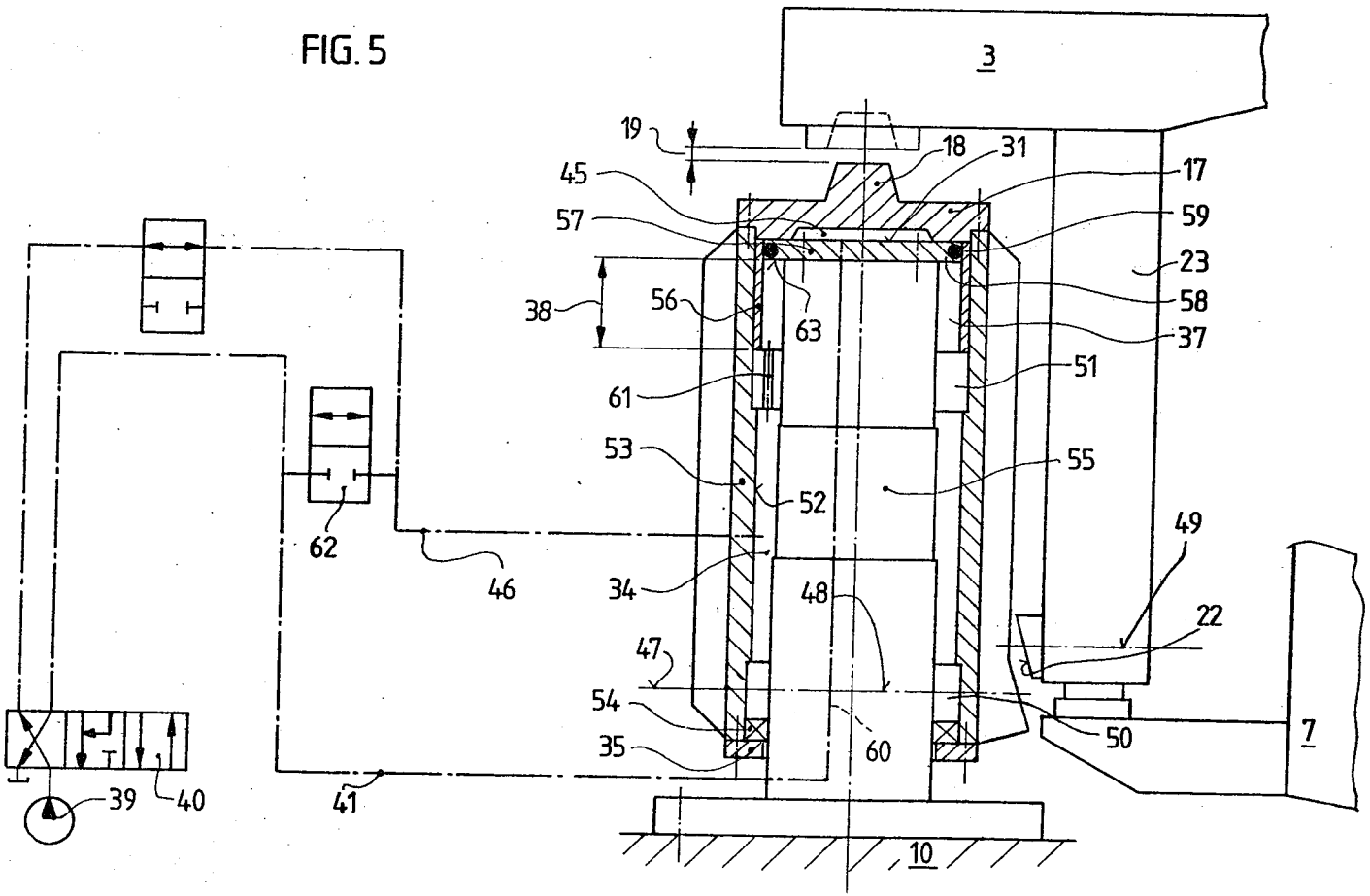
FIGS. 5 and 6 illustrate a further embodiment in illustrations analogous to FIGS. 3 and 4, respectively.
Figure 6:
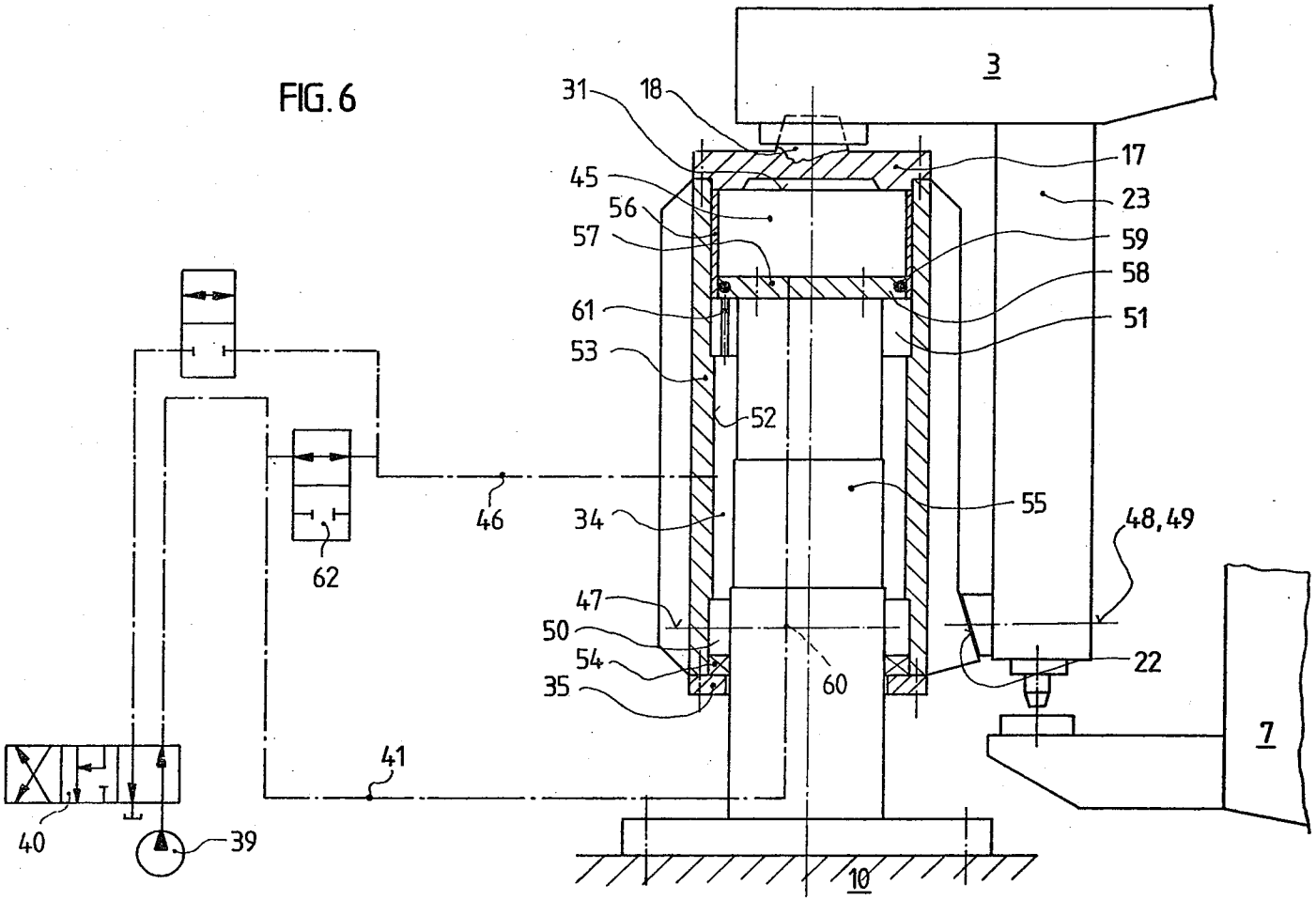

In the embodiment illustrated in FIGS. 5 and 6, the antifriction bearing bushes 50, 51 are fastened to the inner wall 52 of the sleeve 53, the lower antifriction bearing bush 50 being supported on an annular flange 35 forming the lower end of the sleeve via a seal 54 inserted in a casing. With the sleeve 53 lowered, the upper antifriction bearing bush 51 is at a distance that corresponds to the required lifting height 38 of the sleeve, below the upper end of the king post 55. It is secured against displacement in the longitudinal direction by a bush 56. The king post 55, on its upper end, comprises a plate 57 constituting the front face 31, which, with an annular collar 58 projects beyond the circumferential surface of the king post as far as to the inner side of the bush 56. This collar is sealed relative to the inner wall of the bush 56 by a seal 59.

From the lower end of the king post 55 a bore 60 reaches up to its front face 31, through which bore the hydraulic medium destined for lifting is conducted into the cylindrical space 45. The upper antifriction bearing bush 51 is provided with channels designed as bores 61, through which the hydraulic medium gets from the annular space 34 into an annular space 37 located above this antifriction bearing bush. This upper annular space serves for lowering the sleeve. During the lifting procedure hydraulic medium is also supplied to the annular space 37 acting in the lowering direction via a control 62 connecting or disconnecting the two hydraulic conduits 41, 46 according to its position, in order to ensure the lubrication of the two antifriction bearing bushes 50, 51 during lifting. The special advantage of this embodiment is to be seen in the fact that the bearing bushes 50, 51 are always well flowed through and thus excellently lubricated.

During lifting only part of the front face 31 of the king post is active due to the short circuit of the two hydraulic conduits 41, 46, i.e. the front face 31 reduced by the annular surface 63, which is formed on its lower side by the plate 57 constituting the front face.

The lower antifriction bearing bush, with its central line 47, is located at a distance below the central line 49 of the oblique counter surface 22 (with the sleeve lowered), the central lines of the oblique counter surface 22 and of the antifriction bearing bush 50 thus coinciding with the cover carrying structure 3 lifted, which results in a particularly favorable force introduction into the king post 55 via the sleeve 53.

What we claim is:

1. In a lifting means for raising and lowering a furnace cover of an electric furnace, such as an electric arc furnace, a plasma melting furnace and the like, of the type including a base and a cover carrying structure carrying said furnace cover, said cover lifting means including a king post supported on said base, a sleeve surrounding said king post and adapted to be raised and lowered hydraulically relative to said king post for engagement with said cover carrying structure, and a cap provided on said sleeve on its upper end, the improvement comprising a front face on said king post said front face and said cap defining a cylindrical space therebetween, means for supplying an hydraulic medium to said cylindrical space to raise said sleeve relative to said king post thereby to raise said furnace cover, a collar provided on said king post, a first annular space between said collar and the inner wall of said sleeve, means for supplying an hydraulic medium to said first annular space to lower said sleeve thereby to lower said furnace cover, an upper bearing bush and a lower bearing bush arranged between said king post and said sleeve defining a second annular space extending therebetween, and a bore in said king post connecting said second annular space with said cylindrical space between said front face and said cap.

2. A lifting means as set forth in claim 1, wherein said upper and lower bearing bushes are fastened to said king post.

3. A lifting means as set forth in claim 1, wherein said upper and lower bearing bushes are made of bronze.

4. A lifting means as set forth in claim 1, wherein said first annular space is provided below said lower bearing bush.

5. A lifting means as set forth in claim 1, wherein said bearing bushes are fastened to an inner wall of said sleeve in a spaced-apart manner and wherein said bearing bushes are movable with said sleeve.

6. A lifting means as set forth in claim 5, wherein said first annular space is formed between said upper bearing bush and said collar.

7. A lifting means as set forth in claim 6, further comprising a second annular space formed between said upper and said lower bearing bushes, and at least one channel penetrating said upper bearing bush and connecting said first annular space with said second annular space.

8. A lifting means as set forth in claims 5, 6 or 7, further comprising a control valve for hydraulically connecting and disconnecting said cylindrical space with said first annular space.

* * * * *